US008717005B2

(12) United States Patent
Schaffer

(10) Patent No.: US 8,717,005 B2
(45) Date of Patent: May 6, 2014

(54) INHERENTLY ACCURATE ADJUSTABLE SWITCHED CAPACITOR VOLTAGE REFERENCE WITH WIDE VOLTAGE RANGE

(75) Inventor: Gregory L. Schaffer, Cupertino, CA (US)

(73) Assignee: Silicon Laboratories Inc., Austin, TX (US)

( * ) Notice: Subject to any disclaimer, the term of this patent is extended or adjusted under 35 U.S.C. 154(b) by 113 days.

(21) Appl. No.: 13/540,380

(22) Filed: Jul. 2, 2012

(65) Prior Publication Data

US 2014/0002052 A1 Jan. 2, 2014

(51) Int. Cl.
*G05F 1/59* (2006.01)
*G05F 1/618* (2006.01)

(52) U.S. Cl.
USPC ..... 323/316; 323/314

(58) Field of Classification Search
USPC ..... 323/311–317; 327/538–539, 541, 327/554–555
See application file for complete search history.

(56) References Cited

U.S. PATENT DOCUMENTS 3,584,311 A * 6/1971 Schaffer ..... 327/172
4,138,649 A * 2/1979 Schaffer ..... 330/9
4,375,595 A * 3/1983 Ulmer et al. ..... 327/378
4,958,123 A * 9/1990 Hughes ..... 323/316
5,168,179 A * 12/1992 Negahban-Hagh ..... 327/554
5,352,972 A * 10/1994 Pernici et al. ..... 323/313
5,563,504 A 10/1996 Gilbert et al.
6,060,874 A * 5/2000 Doorenbos ..... 323/316
6,191,637 B1 * 2/2001 Lewicki et al. ..... 327/337
6,215,353 B1 * 4/2001 Lewyn ..... 327/538
6,724,260 B2 * 4/2004 Varner et al. ..... 330/288
6,819,163 B1 * 11/2004 Gregoire, Jr. ..... 327/536
7,274,219 B2 * 9/2007 Pai ..... 327/51
7,456,769 B2 * 11/2008 Wang et al. ..... 341/143
7,786,792 B1 * 8/2010 Gay ..... 327/539
7,948,304 B2 * 5/2011 Aruga et al. ..... 327/539
8,258,852 B2 * 9/2012 Leung et al. ..... 327/390
2013/0147559 A1 * 6/2013 Schaffer ..... 330/257

* cited by examiner

*Primary Examiner* — Adolf Berhane
*Assistant Examiner* — Nusrat Quddus
(74) *Attorney, Agent, or Firm* — Gary Stanford

(57) ABSTRACT

A switched capacitor voltage reference including a single bias current source, three capacitors, diode devices, an amplifier and switching circuits for developing a temperature independent reference voltage. A single current source avoids having to match multiple current sources. A first capacitor and at least one diode device set a voltage having a negative temperature coefficient. A second capacitor and each of the diode devices set a voltage having a positive temperature coefficient. A third capacitor allows adjustable gain to enable a wide voltage range including a low voltage such as less than one volt. The switching circuits switch between multiple modes for developing and then combining the different temperature coefficient voltages. The topology allows a simple amplifier to be used. The topology is inherently accurate and does not require device trimming. An averaging method may be used to compensate for any mismatch between the diode devices.

20 Claims, 9 Drawing Sheets

RESET MODE

DIODE MODE

VPTAT MODE

1300

INHERENTLY ACCURATE ADJUSTABLE SWITCHED CAPACITOR VOLTAGE REFERENCE WITH WIDE VOLTAGE RANGE

FIELD OF THE INVENTION

The present invention relates in general to voltage references, and more particularly to an inherently accurate adjustable switched capacitor voltage reference with wide voltage range which is fully configurable to provide a selected voltage reference level including low voltages.

BACKGROUND OF THE INVENTION

U.S. Pat. No. 5,563,504 entitled "Switching Bandgap Voltage Reference" by inventors Barrie Gilbert and Shao-Feng Shu describes a switched capacitor network which is used in conjunction with a single PN junction to form a switching bandgap reference voltage circuit. Gilbert's circuit is based on bandgap references that add a diode voltage to a VPTAT (voltage proportional to absolute temperature) voltage. The diode voltage has a negative temperature coefficient while the VPTAT voltage has a positive temperature coefficient. By properly choosing the two voltages, the temperature effects cancel out which provides a combined voltage that is independent of temperature over moderate temperature ranges.

A fundamental problem with the Gilbert cell is that it requires a supply voltage greater than 1.25 Volts (V). Also, the optimal operating point occurred when the two voltages with opposite temperature coefficients summed to about 1.24V. There are a variety of ways of accomplishing a substantially similar result with other configurations. Also, configurations are known which provide voltage references at other voltage levels. Many of these configurations, however, are not suitable for providing a low voltage reference level, such as a voltage level below 1V. Also, many of these configurations consume appreciable amounts of power and are not suitable for low power applications.

BRIEF SUMMARY OF INVENTION

A switched capacitor voltage reference according to one embodiment includes three capacitors, a current source, multiple diode devices, four switching circuits and an amplifier. The first capacitor is coupled between a first node and a second node. The second capacitor is coupled between the second node and an anode node. The third capacitor is coupled between the second node and a third node. The current source provides a bias current to the anode node. The diode devices include at least one first diode device, each having an anode coupled to the anode node and each having a cathode coupled to a common node. The diode devices further include at least one second diode device, each having an anode coupled to the anode node and each having a cathode coupled to a fourth node. A first switching circuit is configured to couple the first node to a selected one of the anode node and the common node. The second switching circuit is configured to couple the fourth node to a selected one of a disable node and the common node. The third switching circuit is configured to couple the third node to a selected one of an output reference node and the common node. The fourth switching circuit is configured to selectively couple the output reference node to the second node. The amplifier has a first terminal coupled to the common node, a second terminal coupled to the second node, and an output terminal coupled to the output reference node.

A switched capacitor voltage reference according to one embodiment includes an input circuit, three capacitors, multiple diode devices, three switching circuits, a counter and drive circuit, an amplifier and an averaging circuit. The input circuit receives a clock signal for toggling operation between a reset mode and a read mode. The first capacitor is coupled between a first node and a second node, the second capacitor is coupled between the second node and an anode node, and the third capacitor is coupled between the second node and a third node. The current source provides a bias current to the anode node. Each of the diode devices has an anode coupled to the anode node and a cathode coupled to a corresponding one of multiple switch nodes. The first switching circuit is configured to couple the first node to the anode node in the reset mode and to couple the first node to the common node in the read mode. The counter and drive circuit is configured to couple a selected number of the switch nodes to the common node while coupling remaining switch nodes to a disable node in the reset mode. The counter and drive circuit is further configured to couple each of the switch nodes to the common node in the read mode. The second switching circuit is configured to couple the third node to the common node in the reset mode and to couple the third node to a preliminary output node in the read mode. The third switching circuit is configured to couple the preliminary output node to the second node in the reset mode and to decouple the preliminary output node from the second node in the read mode. The amplifier has a first terminal coupled to the common node, a second terminal coupled to the second node, and an output terminal coupled to the preliminary output node. The averaging circuit is configured to average voltage of the preliminary output node during sequential occurrences of the read mode for providing a reference voltage.

A switched capacitor voltage reference according to one embodiment includes an input circuit, three capacitors, a current source, multiple diode devices, four switching circuits, and an amplifier. The input circuit receives a clock signal for toggling operation between multiple modes including a first mode and a second mode. The first capacitor is coupled between a first node and a second node, the second capacitor is coupled between the second node and an anode node, and the third capacitor is coupled between the second node and a third node. The current source provides a bias current to the anode node. Each diode devices has an anode and a cathode. The first switching circuit is configured to couple the first node to the anode node in the first mode and to couple the first node to the common node in the second mode. The second switching circuit is configured to couple at least one and less than all of the diode devices between the anode node and the common node in the first mode, and to couple each of the diode devices between the anode node and the common node in the second mode. The third switching circuit is configured to couple the third node to the common node in the first mode and to couple the third node to an output node in the second mode. The fourth switching circuit is configured to couple the output node to the second node in the first mode and to decouple the output node from the second node in the second mode. The amplifier has a first terminal coupled to the common node, a second terminal coupled to the second node, and an output terminal coupled to the output node.

The diode devices may be PN junction diodes. Alternatively, each diode device may be a transistor, such as a PNP bipolar junction transistors (BJT), an NPN BJT, or other types of transistors which may be diode-coupled, such as field-effect transistors or the like. The disable node may be an open-circuit node for disconnecting one or more diode devices, or may be a source voltage having a voltage level sufficient to turn off a diode device, such as pulling the base of a PNP BJT high for turning it off. The amplifier may be a simple amplifier including a current source and one or more transistor devices.

A single current source avoids having to match multiple current sources. A first capacitor and at least one diode device set a voltage having a negative temperature coefficient. A second capacitor and multiple diode devices set a voltage having a positive temperature coefficient. A third capacitor allows adjustable gain to enable a wide voltage range for the reference voltage including a low voltage such as less than one volt. The switching circuits switch between multiple modes for developing and then combining the different temperature coefficient voltages. The topology allows a simple amplifier to be used. The topology is inherently accurate and does not require device trimming. An averaging method may be used to compensate for any mismatch between the diode devices. PNP transistors are shown in various embodiments although other types of transistors are contemplated.

BRIEF DESCRIPTION OF THE DRAWINGS

The benefits, features, and advantages of the present invention will become better understood with regard to the following description, and accompanying drawings where.

DETAILED DESCRIPTION OF THE INVENTION

The following description is presented to enable one of ordinary skill in the art to make and use the present invention as provided within the context of a particular application and its requirements. Various modifications to the preferred embodiment will, however, be apparent to one skilled in the art, and the general principles defined herein may be applied to other embodiments. Therefore, the present invention is not intended to be limited to the particular embodiments shown and described herein, but is to be accorded the widest scope consistent with the principles and novel features herein disclosed.

A switched capacitor voltage reference as described herein provides an inherently accurate and adjustable voltage reference that allows operation within a relatively wide voltage range. The wide voltage range includes voltages below 1V which is particularly advantageous for complementary metal-oxide semiconductor (CMOS) technologies. One benefit is that a single current source is used for establishing both the diode voltage and the VPTAT voltage, which facilitates inherent accuracy of the architecture. Another benefit is that each of the switches are referenced to a common reference voltage (e.g., ground) or to a very low voltage thus avoiding floating switches, which would otherwise require more voltage headroom for proper operation. Another benefit is that the reference voltage level is configurable by a gain capacitor, which may be adjusted to achieve a wide range of voltage reference values. The architecture described herein may be optimized to operate at low voltages and with low power consumption. Low voltage and power features are advantageous for use in circuitry of battery powered electronic devices and the like.

Figure 1:
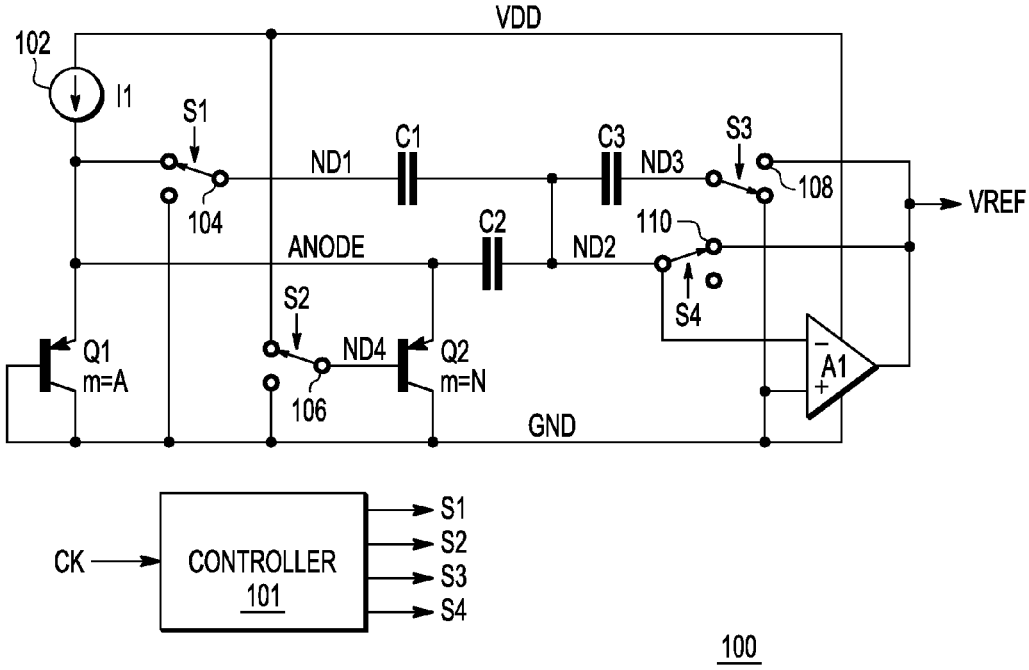
FIG. 1 is a schematic diagram of a switched capacitor voltage reference circuit implemented according to one embodiment of the present invention.

FIG. 1 is a schematic diagram of a switched capacitor voltage reference circuit 100 implemented according to one embodiment. A current source 102 has an input coupled to a source voltage node providing source voltage VDD and an output coupled to a node ANODE, in which the current source 102 sources a current I1 from VDD to ANODE. A PNP bipolar-junction transistor (BJT) Q1 is diode-coupled with its emitter coupled to ANODE and its base and collector coupled to a common reference node shown as ground (GND). GND is a common node which may be any suitable positive, negative or zero voltage level. The node ANODE develops an emitter-base voltage of one or more diode-coupled PNP transistors coupled in parallel as further described herein.

A switch 104 has a first switched terminal coupled to ANODE, a second switched terminal coupled to GND and a common terminal coupled to a node ND1. A first capacitor C1 is coupled between node ND1 and a node ND2, and a second capacitor C2 is coupled between ND2 and ANODE. A third capacitor C3 is coupled between node ND2 and another node ND3. VDD is coupled to a first switched terminal of another switch 106, which has a second switched terminal coupled to GND and a common terminal coupled to a node ND4.

Another PNP BJT Q2 has its emitter coupled to ANODE, its base coupled to ND4 and its collector coupled to GND. Node ND3 is coupled to a common terminal of another switch 108, which has a first switched terminal coupled to an output node VREF and a second switched terminal coupled to GND. Node ND2 is coupled to a common terminal of another switch 110, which has a first switched terminal coupled to VREF and a second switched terminal open-circuited (e.g., not coupled). An operational amplifier (op amp) A1 has power inputs coupled between VDD and GND, an inverting or negative (−) input coupled to ND2, a non-inverting or positive (+) input coupled to GND, and an output coupled to drive VREF.

The switch 104 has a control input receiving a switch control signal S1 for switching ND1 between ANODE and GND. The switch 106 has a control input receiving a switch control signal S2 for switching ND4 between VDD and GND. The switch 108 has a control input receiving a switch control signal S3 for switching ND3 between VREF and GND. The switch 110 has a control input receiving a switch control signal S4 for selectively coupling ND2 to VREF. A controller 101 is shown receiving a clock signal CK and providing the switch control signals S1-S4. Q1 has a relative size of "A" as indicated by an "m" value of "A" or m=A. Q2 has a relative size of "N" as indicated by an "m" value of "N" or m=N. A and N are each positive integers greater than zero. In one embodiment, A=1 in which Q2 is N times the size of Q1, and Q2 is implemented with N substantially identical transistors coupled in parallel in which each is substantially identical to Q1. In alternative embodiments, the value A for Q1 may be greater than 1 so that any size ratio may be chosen between Q1 and Q2. In the embodiments described herein, A is assumed to be 1 in which Q2 is N times the size of Q1, where it is understood that A may be greater than one for alternative ratio configurations.

The switched capacitor voltage reference circuit 100 has many benefits and advantages as described herein. A single current source 102 provides the bias current for establishing both the diode voltage (using Q1) and the VPTAT voltage (using Q1 and Q2). A single current source provides the advantage of avoiding the necessity in many conventional configurations of having to match two different current sources. The switches 104, 106, 108 and 110 are effectively referenced to GND in which switch 110 is referenced to the virtual ground of the amplifier A1. The capacitor C1 is used to establish the diode voltage for providing the negative temperature coefficient component, and the capacitor C2 is used for establishing the VPTAT voltage (along with selection of size N of Q2) for providing the positive temperature coefficient component. Thus, these values may be adjusted to adjust the positive and negative components for specific applications. Furthermore, the capacitor C3 is used as a common gain device. The proper selection of these values allows for a wide selection of the output reference voltage level, including a low reference voltage below 1V. The switched capacitor voltage reference circuit 100 also exhibits lower power consumption as compared to conventional configurations.

Q1 is shown as a diode-coupled PNP BJT and Q2 is shown being diode-coupled when its base is coupled to GND and otherwise being turned off or disabled based on the state of the switch 106. It is appreciated that the PNP transistors are thus coupled as diode devices in which the PN junction between the emitter and base is being utilized as a diode. As a diode device, the emitter of a PNP BJT serves as the "anode" and the base and collector serve as the "cathode" of the diode device. In the case of Q2, the emitter and collector are coupled to ANODE and GND, respectively, and the base is switched between a "disable" node and GND. The disable node is any suitable node that turns off or otherwise disables or disconnects the diode device. As shown, the source voltage VDD has a suitable voltage level to turn Q2 off. In alternative embodiments, Q1 and Q2 may be replaced by other types of diode devices, such as actual diodes, NPN BJTs, field-effect transistors (FETs), etc. In the case of a diode, its anode may be coupled to the ANODE node and its cathode may be coupled to GND (replacing Q1) or selectively coupled between GND and any suitable disable node, such as ANODE, VDD or even an open-circuit node. PNP transistors are shown herein and have at least one advantage over other types of diode devices in that PNP transistors are more easily and/or more accurately matched with each other. Matched diode devices provide the benefit of a more accurate reference voltage at VREF.

The amplifier A1 has a relatively high performance, but may consume a relatively high amount of current and power. The amplifier function performed by A1 may be simplified to substantially reduce current and power consumption to improve overall efficiency. A switched capacitor voltage reference circuit 200 is now described which has the same benefits of the switched capacitor voltage reference circuit 100 with even lower power consumption. It is noted that in the configurations described herein, there may be a trade-off between power consumption (based on current level used) and speed, in which lower power consumption may be achieved at a lower speed, and in which greater speed may be achieved at a higher power consumption.

Figure 2:
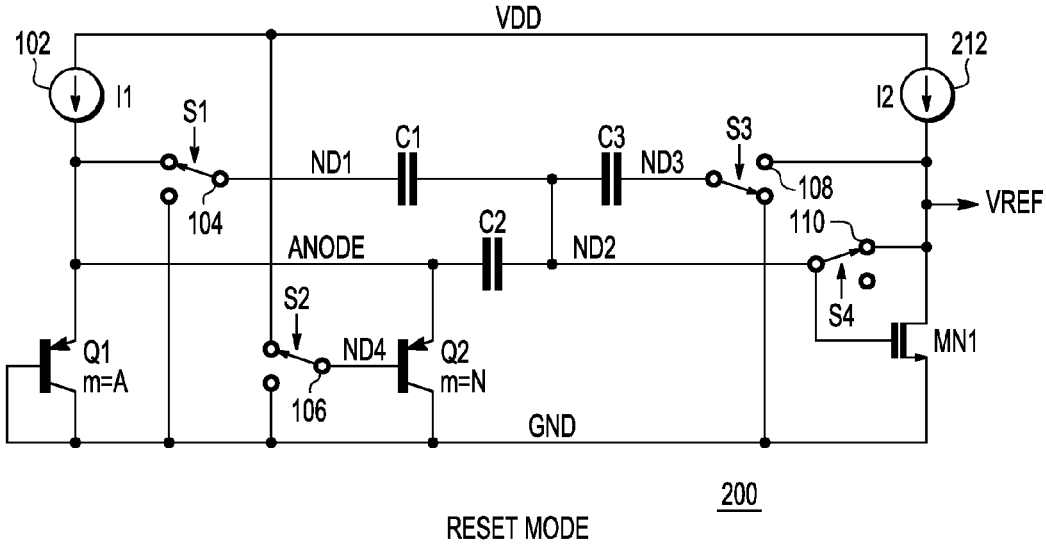
FIG. 2 is a schematic diagram of a switched capacitor voltage reference circuit implemented according to another embodiment in which the amplifier of FIG. 1 is replaced by a transistor and a current source.

FIG. 2 is a schematic diagram of the switched capacitor voltage reference circuit 200 implemented according to another embodiment using a relatively simple amplifier. The controller 101 may be used for controlling switching operation of the switched capacitor voltage reference circuit 200. The switched capacitor voltage reference circuit 200 is substantially similar to the switched capacitor voltage reference circuit 100 except that amplifier A1 is replaced by an N-type MOS (or NMOS) transistor MN1 and a current source 212. The current source 212 has an input coupled to VDD and an output coupled to VREF, and sources a current I2 from VDD to VREF. The drain of MN1 is coupled to VREF, its gate is coupled to node ND2, and its source is coupled to GND. The current source 212 and transistor MN1 collectively operate as a simple amplifier similar to the function of A1 of the circuit 100. It is noted that the current source 212 provides current I2 for biasing the amplifier and does not need be matched to current I1 of the current source 102 for developing VREF.

Although the amplifier formed by current source 212 and MN1 is not an ideal op amp, it has a reasonable voltage gain. In one embodiment, for example, the voltage gain of the amplifier formed by the current source 212 and MN1 is about 60 decibels (dB). Node ND2 behaves in a similar manner as an inverting input to the simple amplifier in which the voltage of ND2 is maintained substantially constant during the three different modes of the switched capacitor voltage reference circuit 200 as further described herein. Because the gain of the simple amplifier is lower than that of the op amp A1, there is a slight error in that the voltage of ND2 does change by a relatively small amount. The resulting error, however, is negligible. In one embodiment, the error of the simple op amp configuration is less than 0.1%.

The operation of the switched capacitor voltage reference circuit 200 is substantially similar to that of the switched capacitor voltage reference circuit 100 except for the static voltage levels of ND2 and VREF during the multiple modes of operation described herein. Although the switch 110 is not reference to GND, it is referenced to a relatively small voltage level VGS, which is the gate-to-source voltage of MN1.

Operation of the switched capacitor voltage reference circuit 200 is now described with reference to FIGS. 2, 3 and 4. As noted above, operation of the switched capacitor voltage reference circuit 100 is substantially the same other than minor discrepancies as noted herein. The switched capacitor voltage reference circuits 100 and 200 both operate in three modes, including a RESET mode, a DIODE mode, and a VPTAT mode for developing the output reference voltage level.

The position of the switches 104, 106, 108 and 110 (as controlled by the corresponding control signals S1, S2, S3 and S4, respectively) shown in FIG. 2 place the circuit 200 in the RESET mode for establishing initial voltages across the capacitors C1, C2 and C3. Switch 106 couples ND4 to VDD which reverse biases Q2's base-emitter voltage (and diode) so that Q2 is turned off. Since Q2 is turned off, the current source 102 provides the current I1 to establish the initial voltage of node ANODE at the emitter-base diode voltage of Q1, referred to as VEB1. Switch 104 couples ND1 to ANODE so that the initial voltage of ND1 is VEB1. Switch 108 establishes the initial voltage of ND3 at 0V (GND). Switch 110 couples the drain and gate of MN1 together so that the drain current of MN1 settles to I2 from the current source 212, and so that the initial voltage of the VREF and ND2 nodes is the gate-source voltage VGS of MN1 at current I2. The RESET mode of the switched capacitor voltage reference circuit 100 is similar, except that the initial voltage of VREF and ND2 is 0V rather than VGS.

Figure 3:
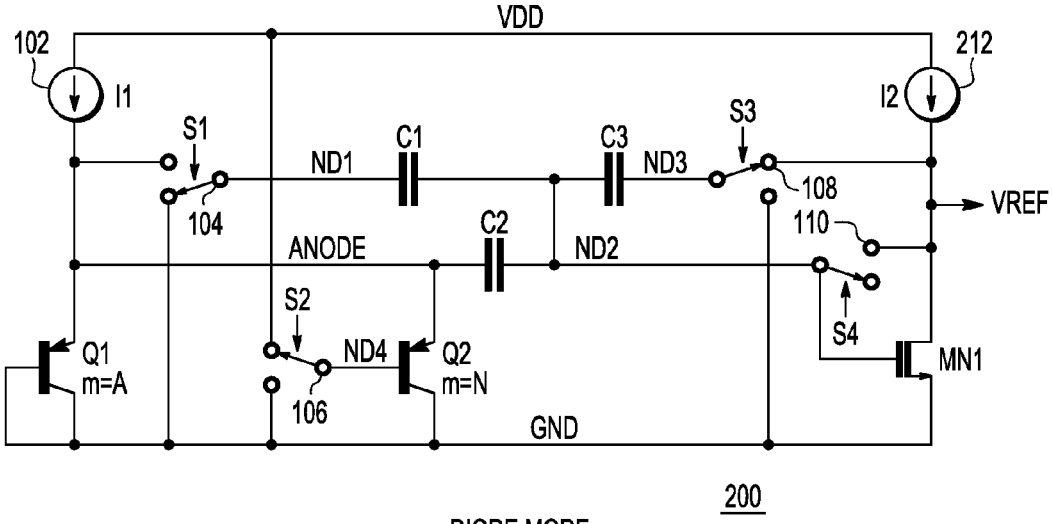
FIG. 3 shows the switched capacitor voltage reference circuit of FIG. 2 in a DIODE mode.

FIG. 3 shows the switched capacitor voltage reference circuit 200 in the DIODE mode which is achieved by switching the states of switches 104, 108 and 110 while switch 106 remains unchanged. First, S4 changes state so that switch 110 switches to decouple node ND2 from VREF. Then S1 and S3 change state so that switches 104 and 108 change state. The DIODE mode operates to sample the diode voltage VEB1 of Q1 to the output node VREF. In the DIODE mode, switch 104 grounds node ND1 and switch 108 inserts the capacitor C3 between nodes ND3 and VREF. MN1 and current source 212 collectively operate to maintain the voltage of node ND2 at VGS after switching.

When the switched capacitor voltage reference circuit 200 switches from the RESET mode to the DIODE mode, the switch 108 provides feedback between VREF and ND2 via node ND3 and C3, so that MN1 operates to re-establish the voltage of ND2 to its original level of VGS. The circuit reaches equilibrium when the current through capacitor C3 flows through the capacitor C1. The voltages of nodes ANODE and ND2 do not change so that the voltage across the capacitor C2 does not change. The voltage across the capacitor C1 changes from VEB1 to 0V so that the charge accumulated on C1 is C1·VEB1 (in which the capacitors C1, C2 and C3 are assumed to have capacitances C1, C2 and C3, respectively). Since the voltage of node ND2 does not change, substantially the same current flows through C3 so that node ND3 changes from 0V to VREF1=(C1·VEB1)/C3. The new voltage of VREF is the same as ND3, so that VREF=VREF1.

VREF1 is the first diode component of the output voltage which depends on C1, C3 and VEB1 and is independent of the capacitance C2. The voltage VEB1 is the diode voltage of Q1 having a negative temperature coefficient in which it decreases with increasing temperature. The actual voltage of VEB1 depends on various factors including temperature. In one embodiment, the change of voltage of VEB1 with temperature is about −2 millivolts (mV) per degree Celsius, or −2 mV/° C.

Figure 4:
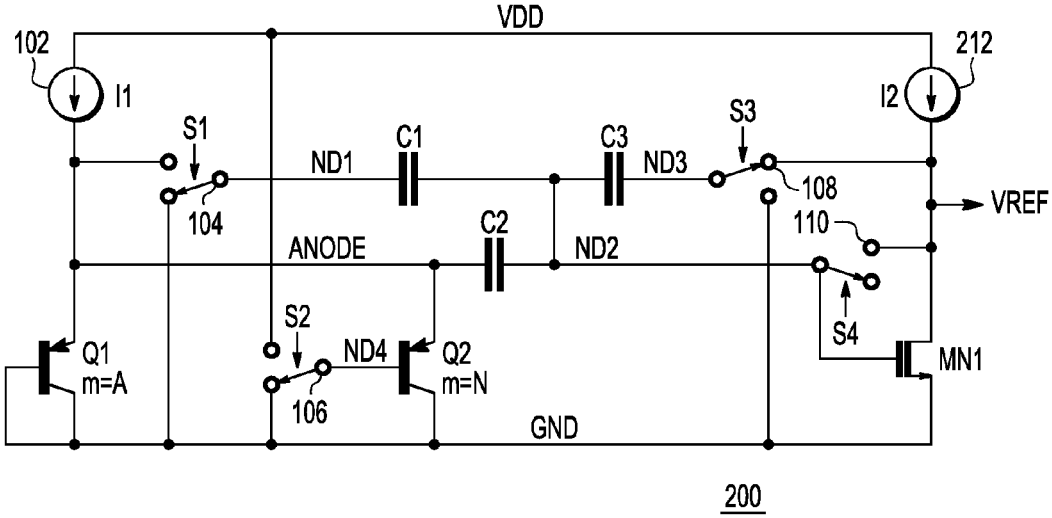
FIG. 4 shows the switched capacitor voltage reference circuit of FIG. 2 in a VPTAT mode.

FIG. 4 shows the switched capacitor voltage reference circuit 200 in the VPTAT mode which is achieved by switching S2 so that the state of switch 106 changes while the switches 104, 108 and 110 remain unchanged. Q2 is turned on and placed in parallel with Q1 between ANODE and GND. Because there are now N+A PNP transistors in parallel (A for Q1 and N for Q2), each has an emitter current of I1/(N+A). Thus, the current of Q1 has changed from I1 to I1/(N+A), which means that the voltage level of node ANODE changes by a voltage of (kT/q)·ln [I1/(I1·(N+A))]=(kT/q)·ln [1/(N+A)], in which "ln" denotes the natural logarithm function, "k" is Boltzmann's constant $1.38066\times10^{-23}$ J/° K, T is temperature in degrees Kelvin (° K), and "q" is the elementary charge of an electron in Coulombs, or $1.60218\times10^{-19}$ C. The value of kT/q is referred to as the "thermal voltage" and has a value of 0.02585V at 300° K (+27° C.). The change in voltage of ANODE (from VEB1 to VEB2) is a VPTAT (voltage proportional to absolute temperature) in the VPTAT mode.

The voltage of node ANODE decreases from the DIODE mode to the VPTAT mode which means that the change in charge of the capacitor C2 is C2·kT/q×ln(N+A). Node ND2 is temporarily pulled negative during the transition, but MN1 operates to re-establish the voltage of node ND2 via feedback current through C3. The change in the voltage of VREF is VREF2=(C2·kT/q·ln [N+A])/C3. It is noted that VREF2 depends only on the values C2, C3, A and N and is independent of C1 since the voltage across the capacitor C1 is the same between the DIODE and VPTAT modes after switching. VREF2 is the VPTAT component of the output voltage having a positive temperature coefficient.

The total output voltage of VREF after the voltages have settled in the VPTAT mode is the sum of the voltages VREF1 and VREF2 (or VREF=VREF1+VREF2) according to the following equation (1):

$$VREF = \frac{(C1 \cdot VEB1 + C2 \cdot kT/q \cdot \ln[N + A])}{C3} \tag{1}$$

Assuming given values of N and A, the diode and PTAT voltages may be adjusted by the capacitances C1 and C2, respectively, so that the change of the sum of the two voltages is approximately zero with changes in temperature. C3 is a common gain term which sets the overall gain to determine the actual output voltage of VREF. It is noted that the gain is inversely proportional to C3 so that a smaller reference voltage is achieved by a larger value of C3 and a larger reference voltage is achieved by a smaller value of C3.

The values of C1, C2, A and N are interdependent. In one embodiment, A is 1 and N is 7 so that Q2 is seven times the size of Q1. In this case, VEB1 is the diode voltage of a single PNP transistor and VEB2 is the diode voltage of eight PNP transistors coupled in parallel. A and N may be any suitable positive integers for different implementations. The relative values of C1 and C2 are selected based on A and N so that the sum of the diode and VPTAT voltages has negligible change with temperature.

Figure 5:
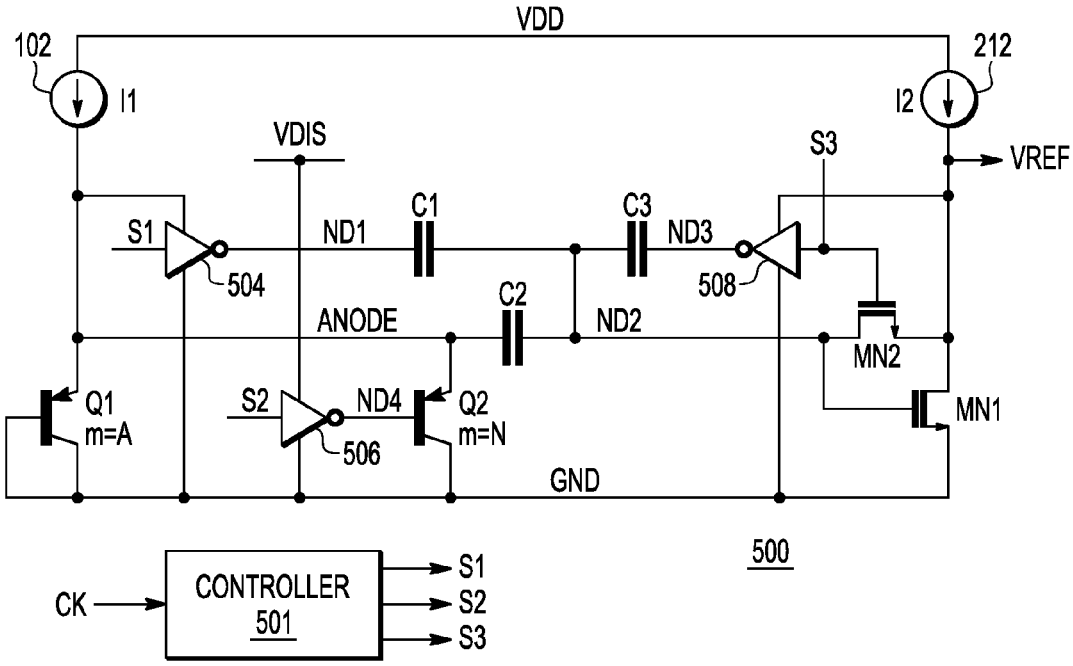
FIG. 5 is a schematic diagram of a switched capacitor voltage reference circuit according to another embodiment which operates in substantially the same manner as the switched capacitor voltage reference circuits of FIGS. 1 and 2 including the RESET, DIODE and VPTAT modes of operation.

FIG. 5 is a schematic diagram of a switched capacitor voltage reference circuit 500 according to another embodiment which operates in substantially the same manner as the switched capacitor voltage reference circuits 100 and 200 including the RESET, DIODE and VPTAT modes of operation. In this case, the switches 104, 106, 108 and 110 are replaced by inverters 504, 506, 508 and NMOS transistor MN2, respectively. The switched capacitor voltage reference circuit 500 provides the same benefits and advantages described above for the switched capacitor voltage reference circuit 200 including a single current source, switches referenced to ground (or low voltage), selectable VREF within a wide voltage range including low voltages, and lower power operation as compared to conventional configurations.

The inverter 504 has an input receiving S1, an output coupled to node ND1, a positive supply voltage input coupled to node ANODE, and a negative supply voltage input coupled to GND. Thus, the inverter 504 switches node ND1 to the voltage level of ANODE when S1 is low and switches node ND1 to GND when S1 is high. The inverter 506 has an input receiving S2, an output coupled to node ND4, a positive supply voltage input coupled to a disable voltage VDIS, and a negative supply voltage input coupled to GND. Thus, the inverter 506 switches node ND4 to the voltage level of VDIS when S2 is low and switches node ND4 to GND when S2 is high. The inverter 508 has an input receiving S3, an output coupled to node ND3, a positive supply voltage input coupled to node VREF, and a negative supply voltage input coupled to GND. Thus, the inverter 508 switches node ND3 to the voltage level of VREF when S3 is low and switches node ND3 to GND when S3 is high. MN2 has its drain coupled to node ND2, its gate receiving S3, and its source coupled to VREF.

The voltage VDIS has a sufficient voltage level to turn Q2 completely off when S2 is low so that inverter 506 pulls node ND4 to VDIS. In an alternative embodiment, the positive supply voltage input of the inverter 506 is coupled to VDD. Either way, Q2 is turned off when S2 is low. MN2 is turned on when S3 is high to couple nodes ND2 and VREF together, and MN2 is turned off when S3 is pulled low. Although MN2 may be controlled by a separate signal S4 such as shown for the switch 110, using the same signal S3 for the inverter 508 and MN2 provides a simplification. S3 is high for the RESET mode so that the inverter 508 pulls ND3 to GND and MN2 is on coupling ND2 to VREF. S3 goes low to switch to the DIODE mode, which couples ND3 to VREF and which turns MN2 off. As previously described when switching from the RESET mode to the DIODE mode, node ND2 should be de-coupled from VREF first. For the switched capacitor voltage reference circuit 500, MN2 turns off faster than the inverter 508 pulls its output high so that S3 may control both devices to meet the timing condition. A simplified controller 501 is shown receiving CK and providing control signals S1-S3.

Figure 6:
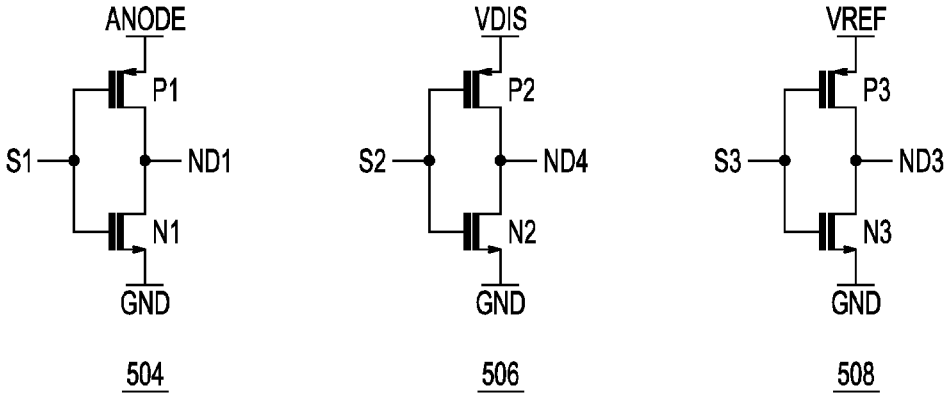
FIG. 6 is a schematic diagram of the inverters of FIG. 5 according to one embodiment.

FIG. 6 is a schematic diagram of the inverters 504, 506 and 508 according to one embodiment. The inverter 504 includes PMOS transistor P1 having its drain coupled to the drain of an NMOS transistor N1 at the node ND1. The gates of P1 and N1 are coupled to receive S1. The source of P1 is coupled to ANODE and the source of N1 is coupled to GND. Similarly, the inverter 506 includes PMOS transistor P2 having its drain coupled to the drain of an NMOS transistor N2 at the node ND4. The gates of P2 and N2 are coupled to receive S2. The source of P2 is coupled to VDIS and the source of N2 is coupled to GND. Also, the inverter 508 includes PMOS transistor P3 having its drain coupled to the drain of an NMOS transistor N3 at the node ND3. The gates of P3 and N3 are coupled to receive S3. The source of P3 is coupled to VREF and the source of N3 is coupled to GND. In this manner, the inverters 504, 506 and 508 operate in a similar manner as previously described for the switches 104, 106 and 108, respectively. It is appreciated that each of the inverters 504, 506 and 508 switch relative to GND.

Figure 7:
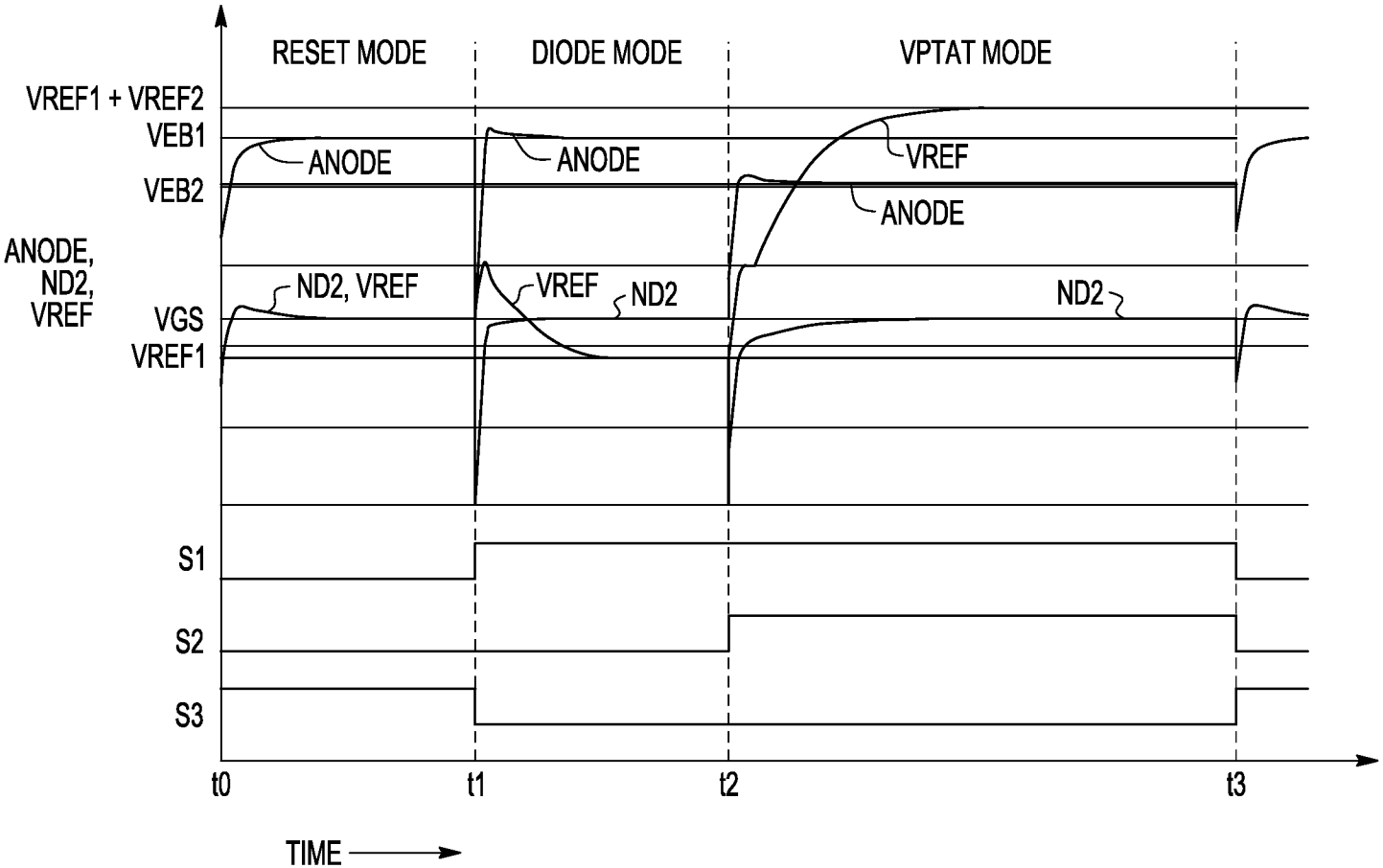
FIG. 7 is a timing diagram in which the voltage levels of nodes and control signals are plotted versus time for the switched capacitor voltage reference circuit of FIG. 5 illustrating the RESET, DIODE and VPTAT modes according to one embodiment.

FIG. 7 is a timing diagram in which the voltage levels of the nodes ANODE, ND2 and VREF and the control signals S1, S2 and S3 are plotted versus time for the switched capacitor voltage reference circuit 500 illustrating the RESET, DIODE and VPTAT modes according to one embodiment. The controller 501 may be used for controlling operation as previously described. At an initial time t0, S1 and S2 are low and S3 is high to initialize the switched capacitor voltage reference circuit 500 in the RESET mode (corresponding to the switched capacitor voltage reference circuit 200 shown in FIG. 2). Nodes ND2 and VREF, which are coupled together, settle to the VGS voltage level, and ANODE settles to the voltage level VEB1.

At t1, S3 is pulled low and S1 is pulled high to switch the switched capacitor voltage reference circuit 500 to the DIODE mode (corresponding to the switched capacitor voltage reference circuit 200 shown in FIG. 3). Nodes ND2 and VREF are de-coupled and ND2 bounces low but settles back to VGS while VREF settles to the voltage level VREF1. The voltage level of ANODE responds to the change of ND2 and then settles back to the voltage level VEB1.

At t2, S2 goes high to switch the switched capacitor voltage reference circuit 500 to the VPTAT mode (corresponding to the switched capacitor voltage reference circuit 200 shown in FIG. 4). ND2 bounces low and then settles back to the voltage level of VGS again. ANODE switches to the voltage level of VEB2. VREF increases by VREF2 and settles at VREF1+VREF2 by a subsequent time t3, in which VREF1+VREF2 is the final voltage reference substantially independent of temperature.

When the temperature increases, the voltage level of VREF1 decreases by an amount whereas the voltage level of VREF2 increases by the same amount so that VREF1+VREF2 remains constant. Likewise, when the temperature decreases, the voltage level of VREF1 increases by an amount whereas the voltage level of VREF2 decreases by the same amount so that VREF1+VREF2 remains constant.

The voltage level of VREF may be sampled or otherwise stored during the VPTAT mode, and operation returns to the RESET mode just after time t3. Operation repeats in this manner for subsequent cycles.

Figure 8:
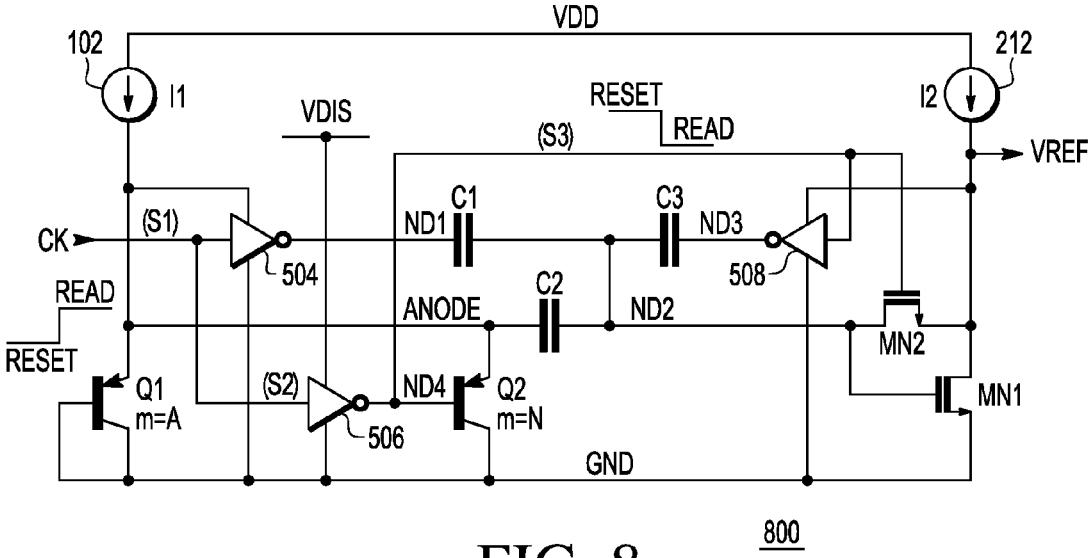
FIG. 8 is a schematic diagram of a switched capacitor voltage reference circuit configured in a substantially similar manner as the switched capacitor voltage reference circuit of FIG. 5.

FIG. 8 is a schematic diagram of a switched capacitor voltage reference circuit 800 configured in a substantially similar manner as the switched capacitor voltage reference circuit 500, in which similar components assume identical reference numbers including the inverters 504, 506, and 508 and the NMOS transistor MN2. The inverters 504, 506, and 508 may be implemented as shown in FIG. 6. The control signals 51 and S2 are both provided by a single clock control signal CK provided to the inputs of the inverters 504 and 506. Furthermore, the control signal S3 is provided by node ND4 at the output of the inverter 506 which is coupled to the input of the inverter 508 and to the gate of MN2. In this manner, a separate controller (e.g., 101, 501) is substantially simplified or even eliminated since control is based on a single clock signal input. The switched capacitor voltage reference circuit 800 provides the same benefits and advantages described above for the switched capacitor voltage reference circuits 200 and 500 including a single current source, switches referenced to ground (or low voltage), selectable VREF within a wide voltage range including low voltages, and lower power operation as compared to conventional configurations.

In this case, CK toggles between two states. When CK is low, ND4 is pulled high and the switched capacitor voltage reference circuit 800 is placed in the RESET mode of operation in substantially the same manner as that for the switched capacitor voltage reference circuit 500. When CK goes high, ND4 is pulled low and the switched capacitor voltage reference circuit 800 is placed in a READ mode of operation. The READ mode of operation effectively combines the functions of the DIODE and VPTAT modes of operation previously described into a single mode.

Figure 9:
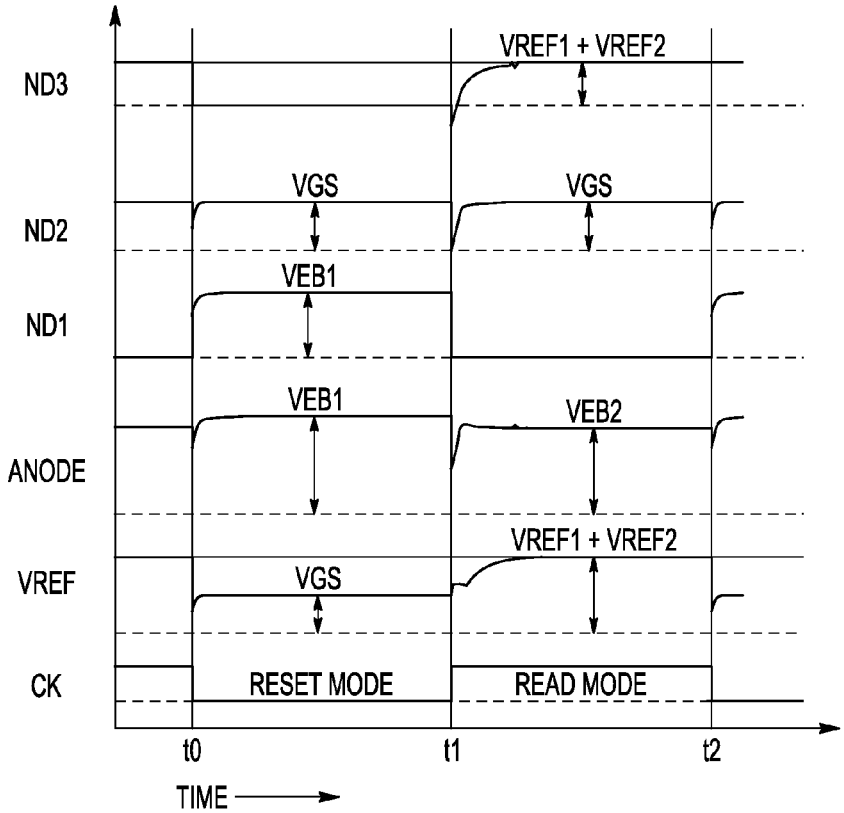
FIG. 9 is a timing diagram in which the voltage levels of the nodes and the clock control signal are plotted versus time for the switched capacitor voltage reference circuit of FIG. 8 illustrating the RESET and READ modes according to one embodiment.

FIG. 9 is a timing diagram in which the voltage levels of the nodes ND3, ND2, ND1, ANODE, and VREF and the CK control signal are plotted versus time for the switched capacitor voltage reference circuit 800 illustrating the RESET and READ modes. It is noted that the voltage scales of the separate plots are independent. At an initial time t0, CK goes low to initialize the switched capacitor voltage reference circuit 800 in the RESET mode. The inverter 508 pulls ND3 low to GND, the nodes ND2 and VREF, which are coupled together via MN2, both settle to VGS (which is the gate-source voltage of MN1), the inverter 506 pulls ND4 to VDIS turning off Q2 so that ANODE settles to VEB1 (which is the diode voltage level of Q1 alone), and node ND1 is pulled to the voltage level of ANODE by the inverter 504, or VEB1.

At subsequent time t1, CK goes high to initiate the READ mode of operation. The inverter 506 pulls node ND4 low to GND turning on Q2 so that Q1 and Q2 are in parallel. In this manner, ANODE settles to the voltage VEB2. ND1 is pulled to GND by inverter 504. ND2 bounces low but settles back to the voltage level of VGS in a similar manner previously described. Since ND1 changes from VEB1 to zero and ND2 returns to the same voltage level of VGS, the current that flows through C1 is applied through C3 so that there is a contribution of VREF1=(C1·VEB1)/C3 to node ND3. At about the same time, the change in charge of the capacitor C2 is C2·kT/q×ln(N+A) so that there is an additional contribution to node ND3 of VREF2=(C2·kT/q·ln [N+A])/C3 in a similar manner previously described. Thus, in the READ mode ND3=VREF1+VREF2. The inverter 508 effectively couples the output node VREF to the voltage level of ND3 so that VREF=VREF1+VREF2 in the READ mode. At subsequent time t2, CK goes back low to switch back to the RESET mode, and operation repeats as CK toggles.

The DIODE and VPTAT modes previously described are combined in the READ mode thereby simplifying operation using only one control signal. As described above, when the temperature increases, the voltage level of VREF1 decreases by an amount whereas the voltage level of VREF2 increases by the same amount so that VREF1+VREF2 remains constant. Likewise, when the temperature decreases, the voltage level of VREF1 increases by an amount whereas the voltage level of VREF2 decreases by the same amount so that VREF1+VREF2 remains constant.

Figure 10:
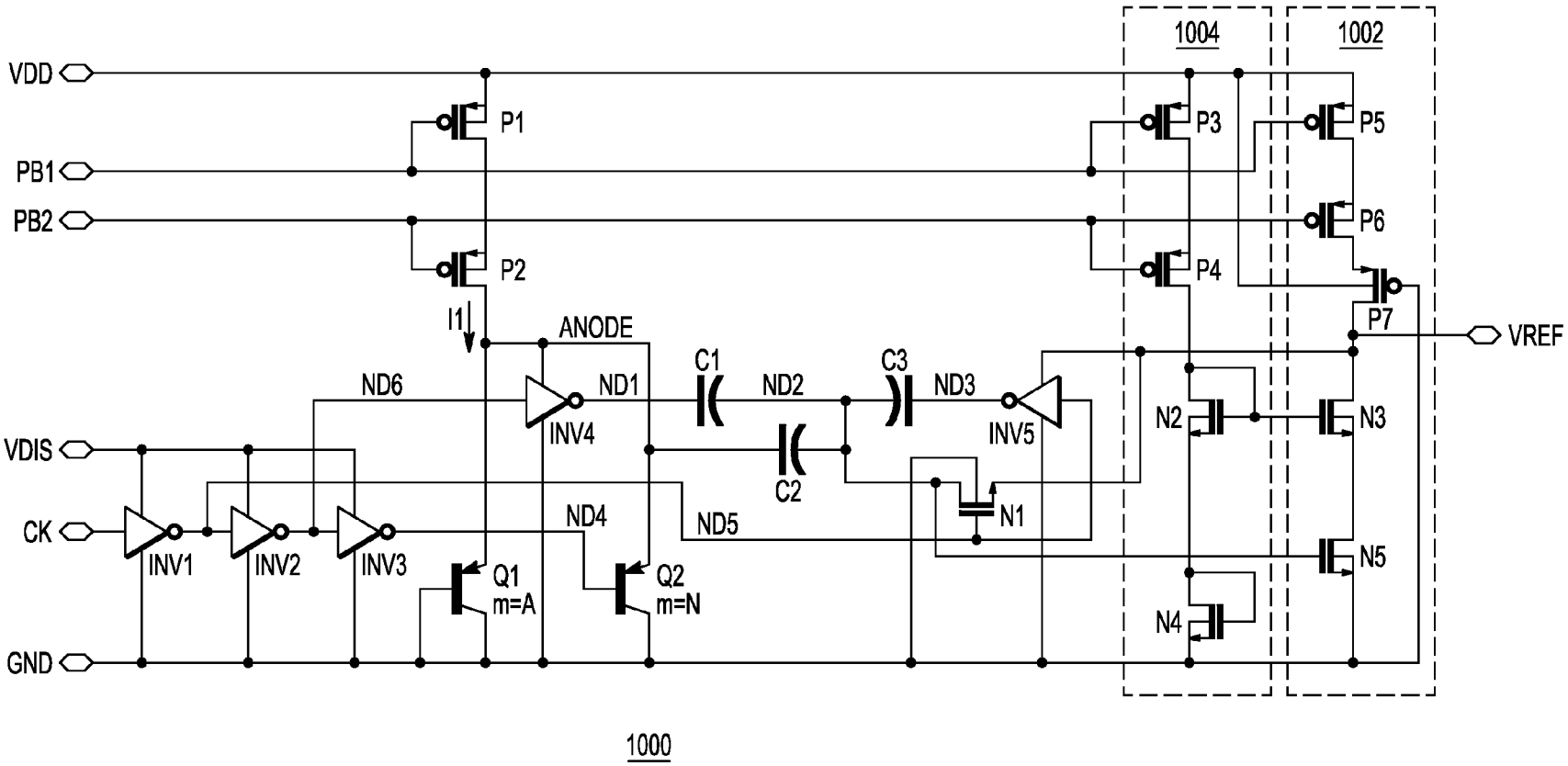
FIG. 10 is a schematic diagram of a switched capacitor voltage reference circuit which is a more detailed embodiment similar in configuration and operation as the switched capacitor voltage reference circuit of FIG. 8.

FIG. 10 is a schematic diagram of a switched capacitor voltage reference circuit 1000 which is a more detailed embodiment similar in configuration and operation as the switched capacitor voltage reference circuit 800. The switched capacitor voltage reference circuit 1000 includes PNP BJTs Q1 and Q2, capacitors C1-C3, inverters INV1-INV5, PMOS transistors P1-P7 and NMOS transistors N1-N5. The switched capacitor voltage reference circuit 1000 provides the same benefits and advantages described above for the switched capacitor voltage reference circuits 200, 500 and 800 including a single current source, ground switches referenced to ground (or low voltage), selectable VREF within a wide voltage range including low voltages, and lower power operation as compared to conventional configurations.

The inverters INV1-INV3 are coupled in series in which the input of INV1 receives CK and the output of INV3 is coupled to node ND4, which is further coupled to the base of Q2. The output of INV1 is coupled to a node ND5, which is further coupled to the input of INV2. The output of INV2 is a node ND6, which is coupled to the inputs of both of the inverters INV3 and INV4. The inverters INV1-INV3 are powered between VDIS and GND. P1 has its source and body junction coupled to VDD, its drain coupled to the source and body junction of P2, and its gate receiving a first bias voltage PB1. P2 has its gate receiving a second bias voltage PB2, and its drain coupled to node ANODE which is further coupled to the emitters of Q1 and Q2. The collectors of Q1 and Q2 and the base of Q1 are coupled to GND.

The output of inverter INV4 is coupled to node ND1 and is powered between nodes ANODE and GND. C1 is coupled between ND1 and ND2, C2 is coupled between ANODE and ND2, and C3 is coupled between ND2 and ND3. ND5 is further coupled to the gate of N1 and to the input of inverter INV5. INV5 is powered between output node VREF and GND and its output is coupled to ND3. N1 has its source coupled to VREF, its drain coupled to ND2, and its body junction coupled to GND. P3 and P5 have their sources and body junctions coupled to VDD and their gates coupled to PB1. The drain of P3 is coupled to the source and body junction of P4 and the drain of P5 is coupled to the source and body junction of P6. The gates of P4 and P6 are coupled to PB2. The drain of P6 is coupled to the source of P7 and the drain of P4 is coupled to the drain and gate of N2 and to the gate of N3. The body junction of P7 is coupled to VDD, its gate is coupled to GND and its drain is coupled to the drain of N3 at the output node VREF. The source and body junction of N2 is coupled to the drain and gate of N4 and the source and body junction of N3 is coupled to the drain of N5. The body junctions and sources of N4 and N5 are coupled to GND. The gate of N5 is coupled to node ND2.

When compared to the switched capacitor voltage reference circuit 800, the transistors Q1 and Q2, the capacitors C1-C3 and the nodes ND1-ND4 are configured in substantially similar manner. P1 and P2 collectively perform the function of the current source 102 in which bias voltages PB1 and PB2 may be used to adjust the bias current I1. MN1 is replaced by N5. The devices P5, P6, P7, N3 and N5 collectively perform the functions of a simple output amplifier 1002 (replacing MN1 and current source 212 providing current I2). The devices P3, P4, N2 and N4 collectively form a bias circuit 1004 for performing bias functions. Inverter INV5 replaces inverter 508 driving node ND3. The inverters INV1-INV3 collectively perform the function of the inverter 506 driving node ND4 based on input clock control signal CK, in which the output of INV1 drives the node ND5 to drive the gate of N1 and the input of inverter INV5 rather than node ND4. The inverter 504 is replaced by the inverter INV4 for driving node ND1.

Operation of the switched capacitor voltage reference circuit 1000 is substantially similar to that described for the switched capacitor voltage reference circuit 800, in which CK toggles operation between RESET and READ modes of operation and VREF develops a temperature independent voltage level.

Figure 11:
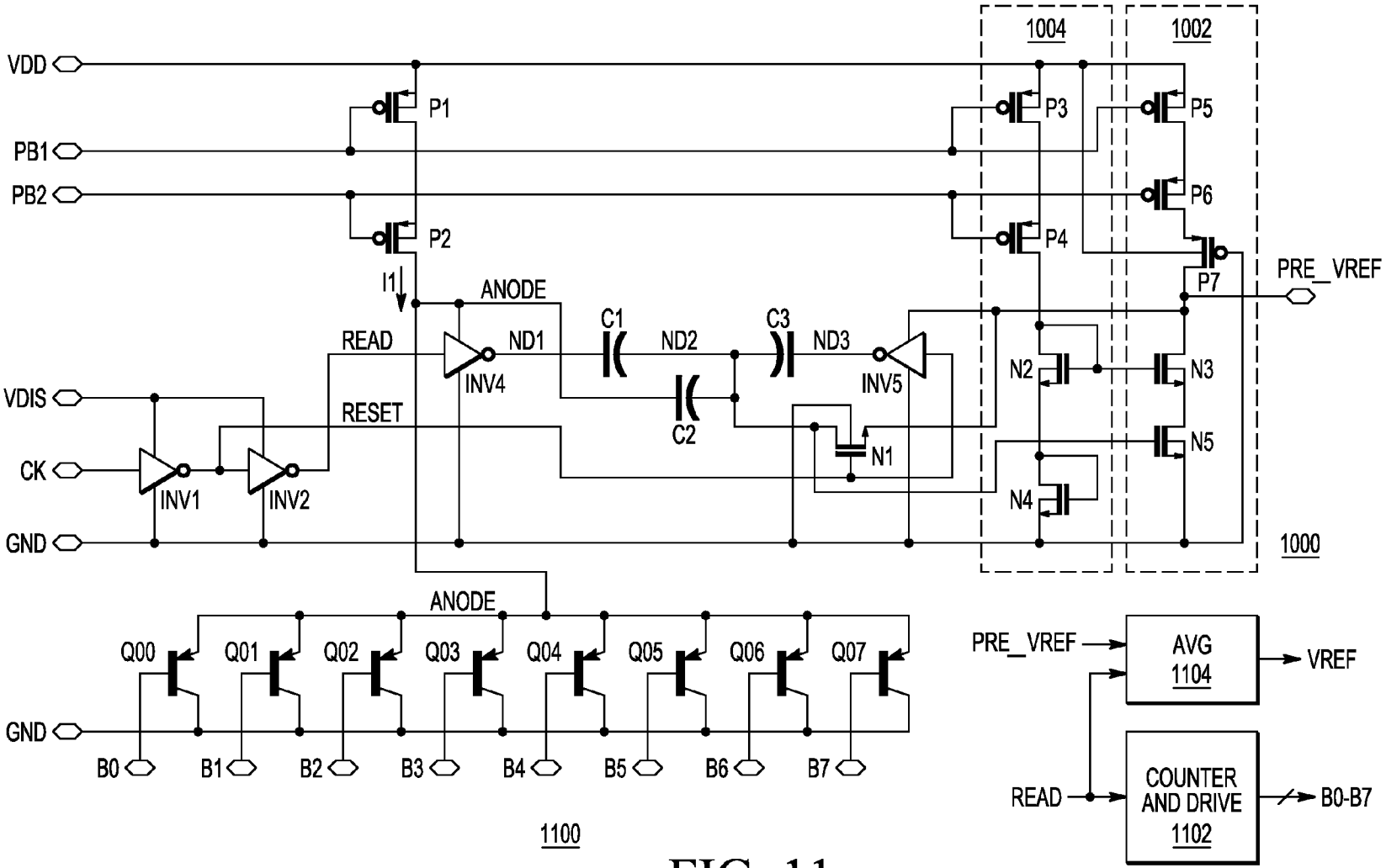
FIG. 11 is a schematic diagram of a switched capacitor voltage reference circuit configured in a substantially similar manner as the switched capacitor voltage reference circuit of FIG. 10 and further including an averaging network for minimizing PNP transistor mismatches.

FIG. 11 is a schematic diagram of a switched capacitor voltage reference circuit 1100 configured in a substantially similar manner as the switched capacitor voltage reference circuit 1000, in which similar components assume identical reference numbers. The switched capacitor voltage reference circuit 1100 provides a correction for any mismatch between the PNP transistors Q1 and Q2. The PNP transistors Q1 and Q2 are replaced by an array of N+A PNP transistors. In the illustrated embodiment, A=1 and N=7, so that there are eight PNP transistors Q00-Q07 each having an emitter coupled to ANODE and a collector coupled to GND. The base terminals of the transistors Q00-Q07 are coupled to an array of switch nodes which receive signals B0-B7, respectively, provided by a counter and drive network 1102 receiving a signal READ which is asserted high during the READ mode of operation. The inverter INV3 is removed. The output of the inverter INV1 provides a signal RESET (replacing ND5) and the output of the inverter INV2 provides the READ signal. The output node provides a preliminary VREF signal referred to as PRE_VREF, which is provided to an averaging network 1104 receiving the READ signal. The averaging network 1104 averages the PRE_VREF signal during READ operation indicated by the READ signal for providing VREF.

Averaging circuits are known and the averaging network 1104 is not further described. The averaging network 1104 may be implemented using a switched capacitor configuration configured as a low pass filter for averaging the PRE_VREF signal during the READ modes of operation.

Figure 12:
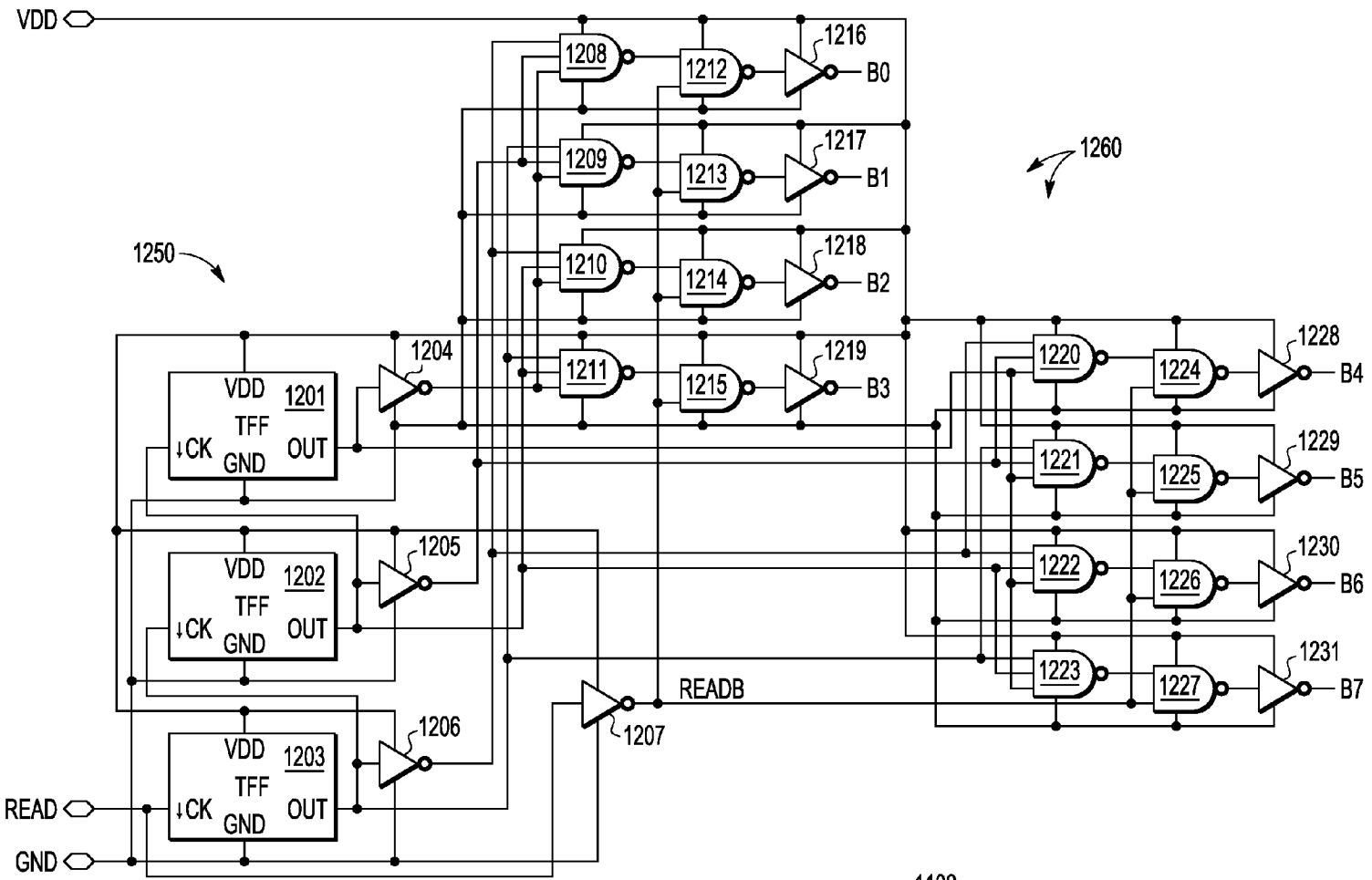
FIG. 12 is a schematic diagram of the counter and drive network of FIG. 11 implemented according to one embodiment.

FIG. 12 is a schematic diagram of the counter and drive network 1102 implemented according to one embodiment. The counter and drive network 1102 as shown includes a binary counter 1250 and a decoder 1260 including the illustrated components powered between VDD and GND. The binary counter 1250 includes three toggle-type flip-flops (TFF) 1201-1203 and four inverters 1204-1207. The decoder 1260 includes a first set of NAND gates 1208-1215 and corresponding inverters 1216-1219 for developing the drive signals B0-B3, and further includes a second set of NAND gates 1220-1227 and corresponding inverters 1228-1231 for developing the drive signals B4-B7.

Each TFF 1201-1203 includes a clock input CK and an output OUT which toggles between logic states upon receiving a falling clock edge input. READ is provided to the clock input of TFF 1203 and to the input of inverter 1207, which provides an inverted read signal READB at its output. The output of TFF 1203 is provided to the input of inverter 1206, the clock input of TFF 1202, and to an input of each of NAND gates 1209, 1211, 1221 and 1223. The output of TFF 1202 is provided to the input of inverter 1205, the clock input of TFF 1201, and to an input of each of NAND gates 1210, 1211, 1222 and 1223. The output of TFF 1201 is provided to the input of the inverter 1204 and to an input of each of NAND gates 1220-1223. The output of inverter 1204 is provided to an input of each of NAND gates 1208-1211. The output of inverter 1205 is provided to an input of each of NAND gates 1208, 1209, 1220 and 1221. The output of inverter 1206 is provided to an input of each of NAND gates 1208, 1210, 1220 and 1222. The output of inverter 1207 is provided to an input of each of NAND gates 1212-1215 and 1224-1227.

The output of NAND gate 1208 is provided to an input of NAND gate 1212, having its output coupled to the input of inverter 1216. The output of NAND gate 1209 is provided to an input of NAND gate 1213, having its output coupled to the input of inverter 1217. The output of NAND gate 1210 is provided to an input of NAND gate 1214, having its output coupled to the input of inverter 1218. The output of NAND gate 1211 is provided to an input of NAND gate 1215, having its output coupled to the input of inverter 1219. The outputs of the inverters 1216-1219 provide the drive signals B0-B3, respectively.

The output of NAND gate 1220 is provided to an input of NAND gate 1224, having its output coupled to the input of inverter 1228. The output of NAND gate 1221 is provided to an input of NAND gate 1225, having its output coupled to the input of inverter 1229. The output of NAND gate 1222 is provided to an input of NAND gate 1226, having its output coupled to the input of inverter 1230. The output of NAND gate 1223 is provided to an input of NAND gate 1227, having its output coupled to the input of inverter 1231. The outputs of the inverters 1228-1231 provide the drive signals B4-B7, respectively.

Operation of the switched capacitor voltage reference circuit 1100 is now generally described. When CK is low, RESET is high and READ is low indicating the RESET mode of operation. In this mode, READB is high and only one of the PNP transistors Q01-Q07 is turned on for the DIODE mode. In particular, the base of the selected PNP transistor is pulled low and the bases of the remaining PNP transistors are pulled high. When CK goes high, RESET goes low and READ goes high so that each of the PNP transistors is turned on for the VPTAT mode. When CK next goes low for the next RESET mode, a different one of the PNP transistors Q01-Q07 is turned on for the next DIODE mode. In this manner, the PNP transistors Q01-Q07 are activated one at a time in round-robin fashion for the sequential RESET/DIODE modes, and each of the PNP transistors Q01-Q07 for each READ/VPTAT mode. In this manner, the PRE_VREF output may change during the READ cycles by an amount associated with any mismatch of the PNP transistors Q01-Q07. The averaging network 1104, however, averages the different PRE_VREF output values over time so that mismatches of the PNP transistors Q01-Q07 are effectively minimized or otherwise eliminated in the VREF output signal.

It is appreciated that a switched capacitor voltage reference as described herein provides many benefits and advantages as compared to conventional voltage reference configurations. As illustrated by the embodiments described herein, including the switched capacitor voltage reference circuits 100, 200, 500, 800, 1000 and 1100, a switched capacitor voltage reference as described herein includes a single current source, switches referenced to ground (or low voltage), selectable VREF within a wide voltage range including low voltages, and may be configured for low power operation.

The accuracy of the reference voltage VREF depends on a number of factors, including the current source providing the bias current I1, the base-to-emitter voltages (VEB) of the PNP transistors, the matching of the capacitors C1-C3, and the design of the output amplifier. A 1% error of the bias current source may cause about a 0.02% error of VREF. It is noted that the offset voltage of the output amplifier does not contribute significantly to error since it gets nullified during the reset mode. The amplifier may be configured with sufficient gain to keep gain errors small.

The VEBs of the PNP transistors cause the largest amount of error or uncertainty of VREF. The amount of error is determined by the specifications of the particular process used. In one embodiment, relatively modest transistor matching results in about 0.5% error. Significantly improved transistor matching methods are known and may be used for further improved accuracy. Furthermore, the transistor correction method shown in FIG. 11 using the array of transistors and the averaging circuits may be used to substantially improve accuracy.

Capacitor mismatch depends on capacitor size and process specifications. In one embodiment for selected capacitor sizes an error of approximately 0.15% is achieved. The capacitors may be made larger to reduce capacitor mismatch, at the expense of increasing the current levels of I1 and I2 with corresponding increase of power consumption An adjustable switched capacitor voltage reference according to the embodiments described herein is inherently accurate and is easily configurable to achieve less than +/−1% error of VREF over the temperature range without trimming. Conventional untrimmed bandgap references, in contrast, have an accuracy in the range of +/−3-5%. Furthermore, the adjustable switched capacitor voltage reference may achieve this accuracy for VREF less than 1V.

Figure 13:
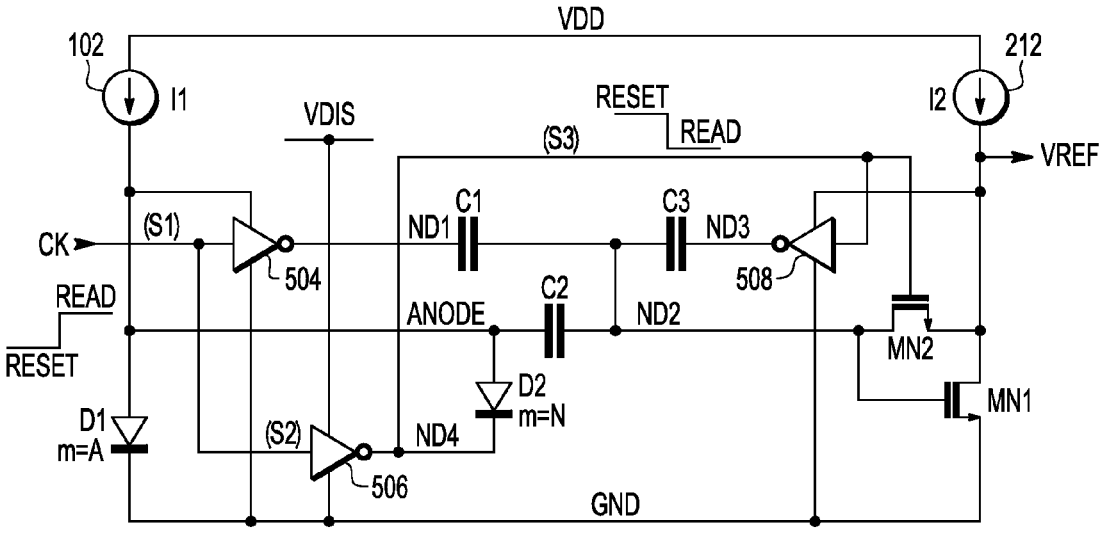
FIG. 13 is a schematic diagram of a switched capacitor voltage reference circuit configured in a substantially similar manner as the switched capacitor voltage reference circuit of FIG. 8 except using diodes as the diode devices.

FIG. 13 is a schematic diagram of a switched capacitor voltage reference circuit 1300 configured in a substantially similar manner as the switched capacitor voltage reference circuit 800, in which similar components assume identical reference numbers. In this case, Q1 is replaced by a diode D1 and Q2 is replaced by a diode D2. D1 has its anode coupled to the ANODE node and its cathode coupled to GND. D2 includes a number A diodes coupled in parallel, in which A may be 1 or more as previously described for Q1. D2 has its anode coupled to ANODE and its cathode coupled to node ND4. D2 includes a number N diodes coupled in parallel, in which N may be 1 or more as previously described for Q2. Operation is substantially the same as that previously described for the PNP transistor embodiments except that the cathode of D2 is switched between VDIS and GND by inverter 506. VDIS is any suitable voltage level sufficient to disable or turn D2 off, such as ANODE, VDD or even an open-circuit.

Figure 14:
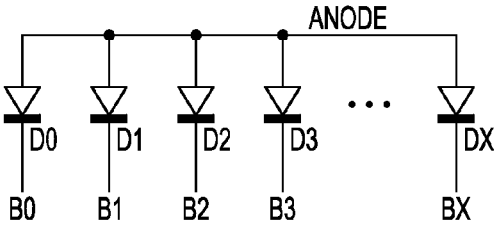
FIG. 14 is a schematic diagram illustrating an array of X+1 diodes coupled to corresponding switch nodes for receiving drive signals which may be used to replace the same number of transistors shown for the switched capacitor voltage reference circuit of FIG. 11.

FIG. 14 is a schematic diagram illustrating an array of X+1 diodes D0, D1, D1, D3, . . . , DX coupled to corresponding switch nodes for receiving drive signals B0, B1, B2, B3, . . . , BX which may be used to replace the same number of transistors Q00-Q07 shown for the switched capacitor voltage reference circuit 1100. Although X may be 7, it is understood that X is any suitable number in which A+N=X+1 where "A" denotes the number of diode devices coupled in a first mode (e.g., RESET, DIODE) and A+N represents all of the diode devices coupled in a second mode (e.g., VPTAT, READ).

While various embodiments of the present invention have been described herein, it should be understood that they have been presented by way of example, and not limitation. It will be apparent to persons skilled in the relevant arts that various changes in form and detail can be made therein without departing from the scope of the invention. Finally, those skilled in the art should appreciate that they can readily use the disclosed conception and specific embodiments as a basis for designing or modifying other structures for carrying out the same purposes of the present invention without departing from the scope of the invention as defined by the appended claims.

The invention claimed is:

1. A switched capacitor voltage reference, comprising:

a first capacitor coupled between a first node and a second node, a second capacitor coupled between said second node and an anode node, and a third capacitor coupled between said second node and a third node;

a current source providing a bias current to said anode node;

at least one first diode device, each having an anode coupled to said anode node and each having a cathode coupled to a common node;

at least one second diode device, each having an anode coupled to said anode node and each having a cathode coupled to a fourth node;

a first switching circuit which is configured to couple said first node to a selected one of said anode node and said common node;

a second switching circuit which is configured to couple said fourth node to a selected one of a disable node and said common node;

a third switching circuit which is configured to couple said third node to a selected one of an output reference node and said common node;

a fourth switching circuit which is configured to selectively couple said output reference node to said second node; and an amplifier having a first terminal coupled to said common node, a second terminal coupled to said second node, and an output terminal coupled to said output reference node.

2. The switched capacitor voltage reference of claim 1, wherein said amplifier comprises:

a second current source providing a second bias current to said output reference node; and a MOS transistor having a drain coupled to said output reference node, having a gate coupled to said second node, and having a source coupled to said common node.

3. The switched capacitor voltage reference of claim 1, wherein said amplifier comprises an operational amplifier having a negative input coupled to said second node, having a positive input coupled to said common node, and having an output coupled to said output reference node.

4. The switched capacitor voltage reference of claim 1, wherein:

said at least one first diode device comprises at least one first PNP bipolar junction transistor, each having an emitter coupled to said anode node and each having a base and a collector coupled to said common node; and wherein said at least one second diode device comprises at least one second PNP bipolar junction transistor, each having an emitter coupled to said anode node, each having a collector coupled to said common node, and each having a base coupled to said fourth node.

5. The switched capacitor voltage reference of claim 4, wherein said disable node comprises a source voltage having a voltage level sufficient to turn off each of said at least one second PNP bipolar junction transistor.

6. The switched capacitor voltage reference of claim 4, wherein said at least one first PNP bipolar junction transistor comprises only one PNP bipolar junction transistor, and wherein said at least one second PNP bipolar junction transistor comprises seven PNP bipolar junction transistors.

7. The switched capacitor voltage reference of claim 1, further comprising:

a controller which is configured to control said first, second, third and fourth switching circuits for sequentially switching between a reset mode, a diode mode, and a VPTAT mode;

wherein in said reset mode, said first node is coupled to said anode node, said second node is coupled to said output reference node, said third node is coupled to said common node, and said fourth node is coupled to said disable node;

wherein in said diode mode, said first node is coupled to said common node, said second node is isolated from said output reference node, said third node is coupled to said output reference node, and said fourth node is coupled to said disable node; and wherein in said VPTAT mode, said first node is coupled to said common node, said second node is isolated from said output reference node, said third node is coupled to said output reference node, and said fourth node is coupled to said common node.

8. The switched capacitor voltage reference of claim 1, further comprising:

a controller which is configured to control said first, second, third and fourth switching circuits for sequentially switching between a reset mode and a read mode;

wherein in said reset mode, said first node is coupled to said anode node, said second node is coupled to said output reference node, said third node is coupled to said common node, and said fourth node is coupled to said disable node; and wherein in said read mode, said first node is coupled to said common node, said second node is isolated from said output reference node, said third node is coupled to said output reference node, and said fourth node is coupled to said common node.

9. The switched capacitor voltage reference of claim 1, wherein:

said first switching circuit comprises a first inverter having an input receiving a first control signal, having an output coupled to said first node, having a positive supply input coupled to said anode node, and having a negative supply input coupled to said common node;

wherein said second switching circuit comprises a second inverter having an input receiving a second control signal, having an output coupled to said fourth node, having a positive supply input coupled to said disable node, and having a negative supply input coupled to said common node;

wherein said third switching circuit comprises a third inverter having an input receiving a third control signal, having an output coupled to said third node, having a positive supply input coupled to said output reference node, and having a negative supply input coupled to said common node; and wherein said fourth switching circuit comprises a MOS transistor having a drain coupled to said second node, having a source coupled to said output reference node, and having a gate receiving said third control signal.

10. The switched capacitor voltage reference of claim 1, wherein:

said first switching circuit comprises a first inverter having an input receiving a clock signal, having an output coupled to said first node, having a positive supply input coupled to said anode node, and having a negative supply input coupled to said common node;

wherein said second switching circuit comprises a second inverter having an input receiving said clock signal, having an output coupled to said fourth node, having a positive supply input coupled to said disable node, and having a negative supply input coupled to said common node;

wherein said third switching circuit comprises a third inverter having an input coupled to said fourth node, having an output coupled to said third node, having a positive supply input coupled to said output reference node, and having a negative supply input coupled to said common node; and wherein said fourth switching circuit comprises a MOS transistor having a drain coupled to said second node, having a source coupled to said output reference node, and having a gate coupled to said fourth node.

11. The switched capacitor voltage reference of claim 6, further comprising:

a first inverter having an input receiving a clock signal, having an output coupled to a fifth node, having a positive supply input coupled to said disable node, and having a negative supply input coupled to said common node;

a second inverter having an input coupled to an output of said first inverter, having an output coupled to a sixth node, having a positive supply input coupled to said disable node, and having a negative supply input coupled to said common node;

wherein said first switching circuit comprises a fourth inverter having an input coupled to said sixth node, having an output coupled to said first node, having a positive supply input coupled to said anode node, and having a negative supply input coupled to said common node;

wherein said second switching circuit comprises a third inverter having an input coupled to said sixth node, having an output coupled to said fourth node, having a positive supply input coupled to said disable node, and having a negative supply input coupled to said common node;

wherein said third switching circuit comprises a fifth inverter having an input coupled to said fifth node, having an output coupled to said third node, having a positive supply input coupled to said output reference node, and having a negative supply input coupled to said common node; and wherein said fourth switching circuit comprises a MOS transistor having a drain coupled to said second node, having a source coupled to said output reference node, and having a gate coupled to said fifth node.

12. The switched capacitor voltage reference of claim 1, wherein said first capacitor has a capacitance for setting a voltage with a negative temperature coefficient, wherein said second capacitor has a capacitance for setting a voltage with a positive temperature coefficient, and wherein said third capacitor has a capacitance for setting a voltage of said output reference node.

13. The switched capacitor voltage reference of claim 1, wherein said first, second and third capacitors, said current source, said amplifier and said plurality of diode devices are configured so that said output reference node develops a temperature independent voltage of less than one volt.

14. The switched capacitor voltage reference of claim 1, wherein said first, second and third capacitors, said current source, said amplifier and said plurality of diode devices are configured so that said output reference node develops a temperature independent voltage.

15. A switched capacitor voltage reference, comprising:

an input circuit receiving a clock signal for toggling operation between a reset mode and a read mode;

a first capacitor coupled between a first node and a second node, a second capacitor coupled between said second node and an anode node, and a third capacitor coupled between said second node and a third node;

a current source providing a bias current to said anode node;

a plurality of diode devices, each having an anode coupled to said anode node and each having a cathode coupled to a corresponding one of a plurality of switch nodes;

a first switching circuit which is configured to couple said first node to said anode node in said reset mode and to couple said first node to said common node in said read mode;

a counter and drive circuit which is configured to couple a selected number of said plurality of switch nodes to said common node while coupling remaining ones of said plurality of switch nodes to a disable node in said reset mode, and which is configured to couple each of said plurality of switch nodes to said common node in said read mode;

a second switching circuit which is configured to couple said third node to said common node in said reset mode and to couple said third node to a preliminary output node in said read mode;

a third switching circuit which is configured to couple said preliminary output node to said second node in said reset mode and to decouple said preliminary output node from said second node in said read mode;

an amplifier having a first terminal coupled to said common node, a second terminal coupled to said second node, and an output terminal coupled to said preliminary output node; and an averaging circuit which is configured to average voltage of said preliminary output node during sequential occurrences of said read mode for providing a reference voltage.

16. The switched capacitor voltage reference of claim 15, wherein said amplifier comprises:

a second current source providing a second bias current to said preliminary output node; and a MOS transistor having a drain coupled to said preliminary output node, having a gate coupled to said second node, and having a source coupled to said common node.

17. The switched capacitor voltage reference of claim 15, wherein each of said plurality of diode devices comprises a PNP bipolar junction transistor having an emitter coupled to said anode node, a collector coupled to said common node, and a base coupled to a corresponding one of said plurality of switch nodes.

18. The switched capacitor voltage reference of claim 15, wherein said counter and drive circuit is configured to select different ones of said plurality of switch nodes as said selected number of said plurality of switch nodes during sequential occurrences of said reset mode.

19. The switched capacitor voltage reference of claim 15, wherein said counter and drive circuit is configured to select only one of said plurality of switch nodes during said reset mode and to cycle through each of said plurality of switch nodes as said only one of said plurality of switch nodes during sequential occurrences of said reset mode.

20. A switched capacitor voltage reference, comprising:

an input circuit receiving a clock signal for toggling operation between a plurality of modes including a first mode and a second mode;

a first capacitor coupled between a first node and a second node, a second capacitor coupled between said second node and an anode node, and a third capacitor coupled between said second node and a third node;

a current source providing a bias current to said anode node;

a plurality of diode devices, each having an anode and a cathode;

a first switching circuit which is configured to couple said first node to said anode node in said first mode and to couple said first node to said common node in said second mode;

a second switching circuit which is configured to couple at least one and less than all of said plurality of diode devices between said anode node and said common node in said first mode, and which is configured to couple each of said plurality of diode devices between said anode node and said common node in said second mode;

a third switching circuit which is configured to couple said third node to said common node in said first mode and to couple said third node to an output node in said second mode;

a fourth switching circuit which is configured to couple said output node to said second node in said first mode and to decouple said output node from said second node in said second mode; and an amplifier having a first terminal coupled to said common node, a second terminal coupled to said second node, and an output terminal coupled to said output node.

* * * * *